United States Patent [19]

Legille et al.

[11] 4,243,351

[45] Jan. 6, 1981

[54] METHOD OF AND APPARATUS FOR CHARGING A FURNACE

[75] Inventors: Edouard Legille, Luxembourg; Rene Mahr, Howald-Hesperange; Pierre Mailliet, Howald, all of Luxembourg

[73] Assignee: Paul Wurth S.A., Luxembourg, Luxembourg

[21] Appl. No.: 911,189

[22] Filed: May 31, 1978

[30] Foreign Application Priority Data

Jun. 6, 1977 [LU] Luxembourg ..... 77547

[51] Int. Cl.[3] ..... C21B 7/20; F27B 1/20

[52] U.S. Cl. ..... 414/206; 193/16; 414/199; 414/161

[58] Field of Search ..... 193/16–21; 414/160, 161, 167, 199, 206, 299; 266/176, 183

[56] References Cited

U.S. PATENT DOCUMENTS

| | | | |
|---|---|---|---|
| 1,774,800 | 9/1930 | Luedtke | 193/16 |
| 3,693,812 | 9/1972 | Mahr | 414/206 X |
| 3,880,302 | 4/1975 | Legille | 414/206 X |
| 3,899,088 | 8/1975 | Furuya | 414/206 |
| 3,921,831 | 11/1975 | Takahashi | 414/206 |
| 3,955,693 | 5/1976 | Legille | 414/206 X |
| 4,032,024 | 6/1977 | Genge | 414/199 |
| 4,040,530 | 8/1977 | Mahr | 414/206 X |
| 4,042,130 | 8/1977 | Legille | 193/16 X |

FOREIGN PATENT DOCUMENTS

| | | |
|---|---|---|
| 2104116 | 8/1972 | Fed. Rep. of Germany . |
| 2405026 | 8/1976 | Fed. Rep. of Germany . |

*Primary Examiner*—L. J. Paperner
*Assistant Examiner*—Terrance L. Siemens
*Attorney, Agent, or Firm*—Fishman and Van Kirk

[57] ABSTRACT

An apparatus and process for introducing and distributing a charge within a shaft furnace, the shaft furnace charging apparatus comprising an elongated charge distribution chute, the angle of which being adjustable in relation to the vertical axis of the furnace to allow for distribution of charge to desired areas within the furnace. The charge distribution chute includes a first end for accepting the charge and a second end for distributing the charge within the furnace. The first end of the chute is suspended from a supporting fork which is rotatable about its axis to provide for pivoting of the chute about a first axis when the support fork is rotated. The chute is suspended from the support fork to provide for pivoting of the chute about a second axis which is preferably perpendicular to the first axis. The direction of the chute within the furnace may be adjusted to provide for distribution of the charge to the desired area of the furnace.

19 Claims, 28 Drawing Figures

Fig. 10
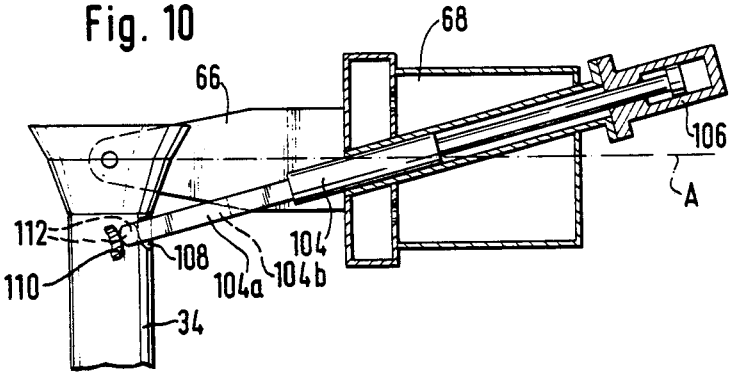
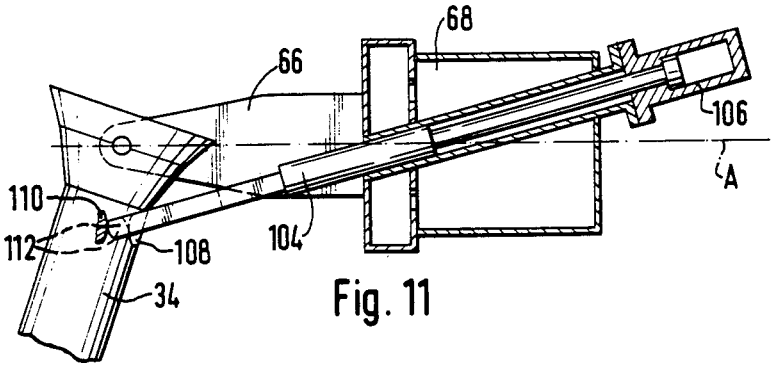
Fig. 11
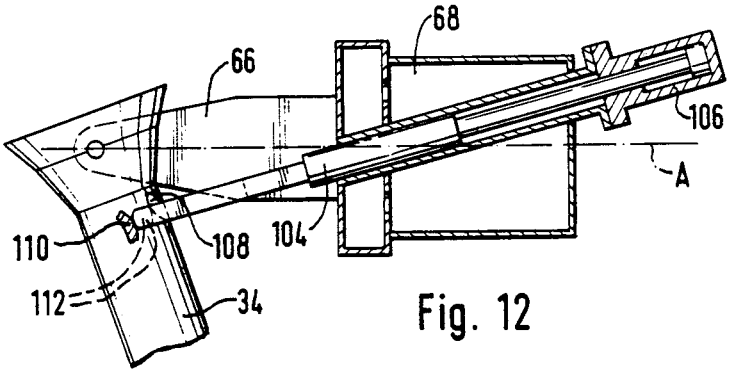
Fig. 12

Fig. 13
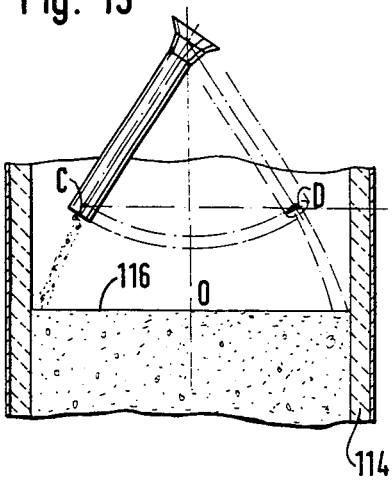
Fig. 14
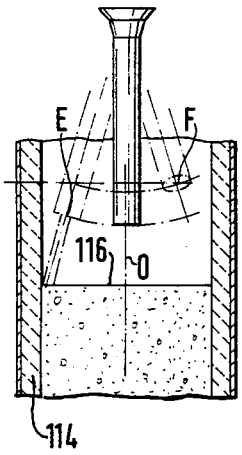
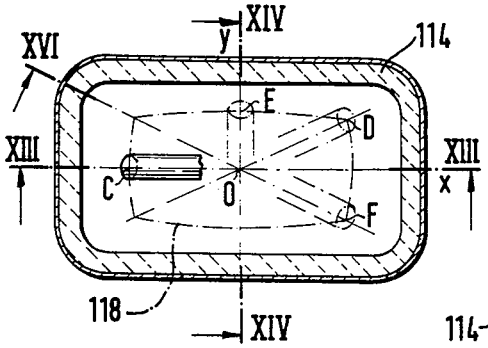
Fig. 15
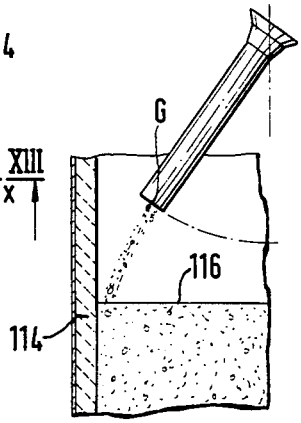
Fig. 16

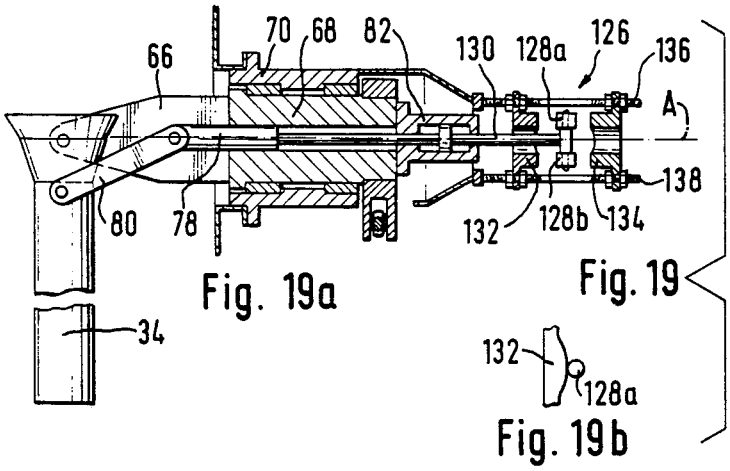
Fig. 19a
Fig. 19
Fig. 19b
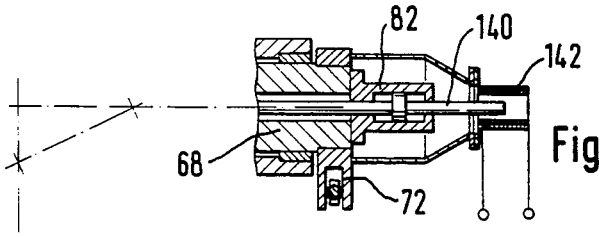
Fig. 20
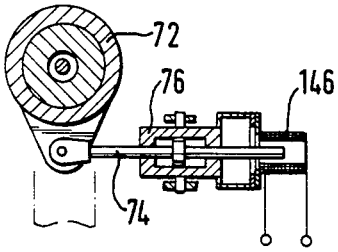
Fig. 21
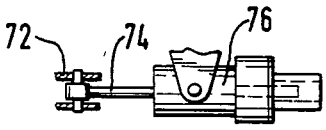
Fig. 22

METHOD OF AND APPARATUS FOR CHARGING A FURNACE

BACKGROUND OF THE INVENTION (1) Field of the Invention

The present invention relates to an apparatus for and process of charging a shaft furnace of the type used in the manufacture of steel. More particularly, the present invention relates to an apparatus for and process of introducing and distributing charge to a desired area within a shaft furnace.

(2) Description of the Prior Art

The construction of modern high production blast furnaces imposes new and more stringent demands on the apparatus for charging the blast furnace due to increased internal pressures within the furnace and increased surface dimensions of the burden over which the charge must be distributed.

Conventional charging devices such as those employing charging bells and compensating chambers exhibit a number of serious disadvantages. With the use of charging bells and compensating chambers, optimum distribution of the furnace charge over the charging area was either difficult or possible. In the prior art, it was determined that it was desirable to control the distribution of the charge within the furnace.

U.S. Pat. No. 3,693,812 describes a device which provides for distribution of a furnace charge in the desired areas inside the furnace. This patent discloses a charging apparatus wherein a chute is rotated about the vertical axis of the furnace, the angular position of the chute in relation to the axis of the furnace being adjustable. In the device described in this patent, one mechanical means rotates the chute and another mechanical means adjusts the angular position of the chute in relation to the axis. U.S. Pat. No. 3,880,302 discloses a mechanism for rotating the chute and for adjusting the angular position of the chute. In the improved mechanism disclosed in this patent, the movement of the chute is provided by two separate motors, by the use of wheels, by differential gears and by planetary gears. These driving mechanism enable the chute to be directed toward any desired point on the surface of the burden so that the charge may be deposited in patterns allowing for optimum operation of the furnace. However, these driving mechanisms are complex and expensive to manufacture.

The rotary-chute charging devices described above are particularly suited for distribution of charge in a shaft furnace having a circular cross section. This is particularly the case in that it is the general practice to distribute the charge in concentric circles. Alternatively, the charge may be distributed in a spiral configuration. However, it has been found that the rotary-chute charging devices of the prior art are unsatisfactory for use in furnaces having irregularly shaped cross sections, that is, noncircular cross sections such as polygons including rectangular or square cross sections. In order to use a rotary-chute charging device in a polygonal shaped blast furnace, it is necessary to use extremely complex regulating programs.

In addition to the above-described rotary-chute charging devices, other devices have been proposed which allow for control of the direction of a chute within a blast furnace in order to distribute charges in a desired manner. German Patent Application No. 2,104,116 discloses a chute mounted by means of a cardanic suspension so that the chute can be directed toward any point without having to rotate the chute suspension system. However, the mechanisms for mounting, securing and driving the chute are extremely complex so that the device is not, in general, desirable to use in connection with blast furnaces. Moreover, this patent application does not disclose a process for charging a furnace having a rectangular cross section.

A particular problem is prevalent with blast furnaces having a rectangular cross section. As the charge flow downwardly through the chute, the charge travels in a linear pattern. However, once the charge is ejected from the chute, the charge free-falls in a parobolic pattern into the furnace. When it is desired to introduce charge into the corners of a furnace having a rectangular cross section, the direction of the chute must be adjusted upwardly to enable the accurate placement of the charge in the corners. In the aforementioned patents and patent applications, this problem was not confronted in that the furnaces described were of a circular cross section. As disclosed in these patents and patent applications, the chutes could be angled in order to fill areas of the burden near the walls of the cylindrically shaped blast furnace.

It is one object of the present invention to provide a shaft furnace charging apparatus which will distribute charge within furnaces having either a circular cross section or those with an irregular cross section.

Another object of the present invention is to provide a furnace charging apparatus that has a simple structure and that is relatively inexpensive to construct.

It is a further object of the invention to provide a shaft furnace charging apparatus which is readily accessible and separable into its various parts to provide for maintenance thereof.

It is another object of the invention to provide a process for introducing and distributing a charge in a shaft furnace in a way so as to insure that the charge will be distributed in an optimal manner regardless of the shape of the cross section of the furnace.

SUMMARY OF THE INVENTION

The present invention provides a shaft furnace charging apparatus for use in a blast furnace of the type having either a circular cross section or an irregular cross section such as retangular or square. The shaft furnace charging apparatus of the present invention comprises an elongated charge distribution chute having a first end for accepting the charge and a second end for distributing the charge within the furnace. The distribution chute is suspended within the furnace by a rotatable support fork which engages the first end of the chute to allow pivoting of the chute about a first axis when the support fork is rotated. The chute is suspended from the support fork to allow pivoting of the chute about a second axis which intersects the first axis at a pivot point. Preferably, the first axis is perpendicular to the second axis. Rotation of the support fork may be provided by any mechanical means such as, for example, a hydraulic actuator. Pivoting of the chute about the second axis can be provided for by a mechanical actuator that is activated independently of the mechanical actuator for providing rotation of the support fork.

In order to allow for removal of the chute, the support fork and the displacement mechanisms for movement of the chute, the upper portion of the chamber is provided with a lateral aperture through which the chute, the support fork and the displacement mechanisms may be withdrawn.

In a preferred embodiment of the invention, the first end of the chute includes a divergent conical portion which functions to receive the charge. The manner by which the chute is suspended from the support fork is as follows. Between the two ends of the support fork is located a saddle which is annular in shape and which terminates in a ring. The tubular portion of the chute is retained in the ring and the divergent conical portion of the chute is releasably held by the saddle. Rotation of the support fork about its longitudinal axis pivots the chute about a first axis. A pair of brackets secured at diametrically opposite points to the fork define a second axis about which the chute pivots. The ring is provided with a pair of brackets at diametrically opposite points on the ring and the brackets are engaged with a displacement mechanism which functions to pivot the chute about the second axis. Preferably, the chute simply rests in the saddle and the ring without requiring a special securing device so that the chute can be disengaged from the ring and saddle and removed from the furnace with great ease in order to allow replacement or maintainence. In the first embodiment of the invention, a first displacement motor causes a cylindrical socket which is integral with the fork support to rotate about the socket's longitudinal axis to provide for rotation of the fork and pivoting of the chute about the first axis. In order to provide pivoting of the chute about the second axis, a push rod, which is preferably positioned coaxially with respect to the cylindrical socket, is connected via a connecting rod to the suspension ring. When the push rod is pushed inwardly and outwardly with respect to the cylindrical socket by any type of conventional motor, the chute pivots about the second axis. Passageways are included within the fork support and the push rod in order to allow delivery and circulation of cooling fluid through the mechanisms to cool friction contact surfaces and increase the resistance of the mechanisms to wear.

In the process of introducing and distributing a charge into a furnace, the direction of the chute can be controlled by pivoting of the chute about the first and/or the second axis. A suitable program may be adopted for directing the lower end of the chute so that the charge material can be distributed over the entire surface of the burden in the furnace and spread in an optimal manner. The flow of material from an intermediate storage chamber may be regulated by a proportioning valve. The flow through the proportioning valve is regulated with the movement of the chute in order to distribute the desired amount of charge in any given place. In a blast furnace having a rectangular shape, the present invention provides a mechanical means for automatically adjusting the angle of the chute so as to enable the charge to reach the corners of the rectangular blast furnace.

Further features and advantages of the present invention will be apparent from the following detailed description of the invention which refers to the figures described below.

BRIEF DESCRIPTION OF THE DRAWINGS

FIGS. 10, 11 and 12 show schematically the pivoting of the chute about the second axis, the pivoting mechanism being a variant of the pivoting mechanism shown in FIGS. 3, 4 and 5;

FIGS. 13, 14, 15 and 16 show schematically the charging process in a furnace having a rectangular cross section wherein the entire surface of the burden is swept by the chute. More particularly, FIG. 13 shows a sectional view along the line XIII—XIII of the furnace shown in FIG. 15;

FIG. 14 shows a sectional view along the line XIV—XIV of FIG. 15;

FIG. 16 shows a sectional view along the line XVI—XVI of FIG. 15;

FIG. 19 which includes FIGS. **19*a* and 19*b* describes a first embodiment of the charging apparatus in order to effect the corrections illustrated in FIG. 18**;

FIGS. 20, 21 and 22 are schematic diagrams of a second embodiment of the invention which provides the corrections illustrated in FIG. 18, FIG. 20 being a side view of the apparatus, FIG. 21 being a frontal view of the apparatus and FIG. 22 being a view of the apparatus shown in FIG. 21 rotated 90°.

DETAILED DESCRIPTION OF THE INVENTION

Figure 1:
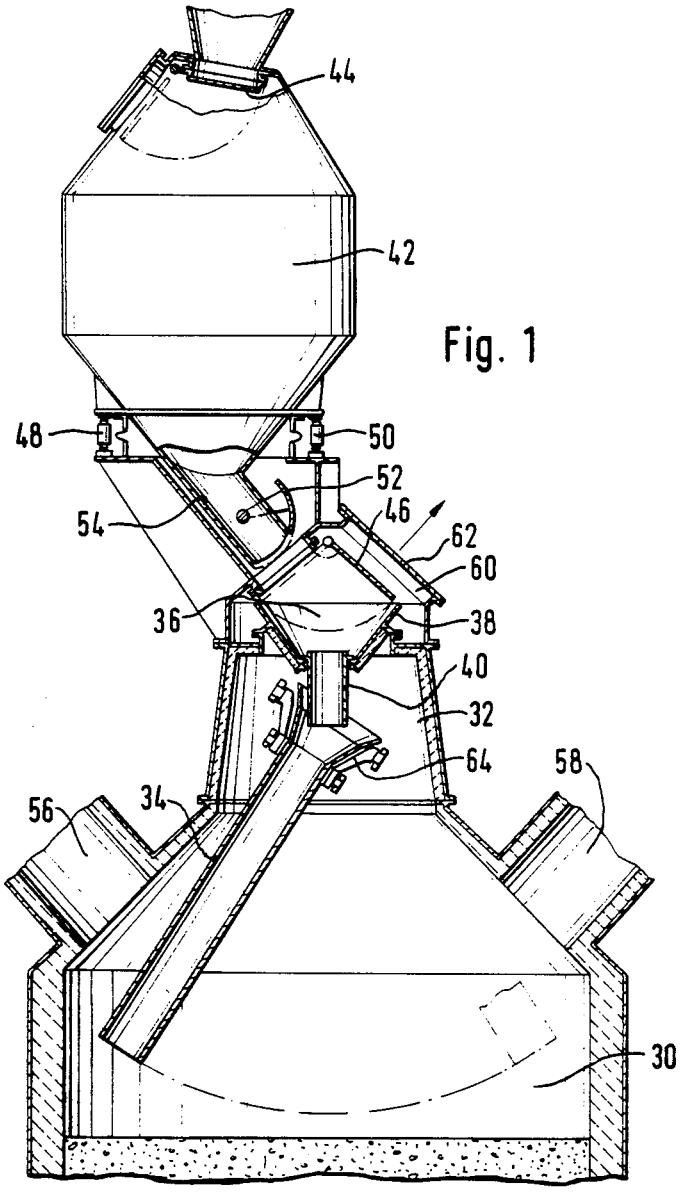
FIG. 1 is a schematic diagram in vertical section of a blast furnace including the charging apparatus.

The present invention will be described with respect to a furnace having a rectangular cross section. The most common type of furnace having a rectangular cross section is a "PUROFER" furnace. It should be nevertheless emphasized that the present invention has applications in furnaces having various cross sections such as polygonal cross sections or arcuately shaped cross sections. Referring to FIGS. 1–9, the upper part of the furnace is referred to generally by reference character 30 and has a rectangular cross section. A tubular chute 34 having an upper portion for receiving the charge and a lower portion for distributing the charge is mounted in the head 32 of the furnace. The upper portion of the tubular chute includes a divergent conically shaped portion which functions to allow for reception of the charge and which, as will be described in more detail hereinafter, provides for a unique suspension system for the chute.

Positioned above the divergent end of chute 34 is a charging mouth 36 which comprises a funnel shaped hopper 38 and a vertical feed channel 40 which protrudes a slight distance into the divergent part of chute 34, preferably, does not touch chute 34. Feed channel 40 may be mounted by means of a circular shoulder in the lower part of hopper 38. Thus, feed channel 40 may be released without dismantling mechanical retainers. Channel 40 also penetrates the hopper 38 to a certain height in order to form a continuous box structure, the purposes and advantages of which are described in greater detail in U.S. Pat. No. 4,040,530.

The material with which the furnace is to be charged, that is, crude iron ore, is taken by a conveyor belt or skip to the top of the furnace and poured into an intermediate storage enclosure 42. Enclosure 42 is designed as a chamber for the purpose of equalizing pressures and is equipped with an upper sealing valve 44 and a lower sealing valve 46. Valves 44 and 46 are actuated in a manner well known in the art whereby chamber 42 is isolated from the interior of the furnace 30 by means of valve 46 during the filling of chamber 42; the chamber is isolated from the external environment by means of valve 44 when the charge material flows from chamber 42 into furnace 30.

A proportioning valve 52 is provided in discharge channel 54 in order to regulate the flow of charge from chamber 42. The position of proportioning valve 52 determines the quantity of material per unit of time introduced into the furnace.

In order to determine the weight of the charge material within chamber 42 at any given time, chamber 42 is provided with weight measuring cells 48 and 50. However, it should be understood that other devices for determining the weight of material in the chamber or the height of the charged material within the chamber may be used. For example, conventional radiation type probes may be used. Measurements indicating the quantity of material contained in chamber 42 may be used to control the operation of proportioning valve 52 which in turn controls the supply of charge to the furnace. Furnace 30 also includes two gas intakes 56 and 58. Other accessories and equipment generally included in blast furnaces, such as, for example, vertical strobes which serve to determine the upper limits of the burden, have not been shown.

The upper regions of furnace 30 define a furnace head 32 which includes an access aperture 60 which may be hermetically sealed by cover 62, the dimensions of aperture 60 being sufficient to enable the charging mouth 36 and the chute 34 to be withdrawn therethrough. In order to release charging mouth 36, access cover 62 is removed. Channel 40, which has the shape of a cylindrical tube having a flange at one end thereof and which engages the flange of hopper 38, is then disengaged from hopper 38 without dismantling complicated mechanical securing mechanisms. After the removal of channel 40, hopper 30 can be detached from the flange in the upper regions of the furnace head 32 and then tilted slightly in order to fit through aperture 60. The removal of the channel 40 and hopper 38 is accomplished by a suitable mechanical lifting device.

Figure 2:
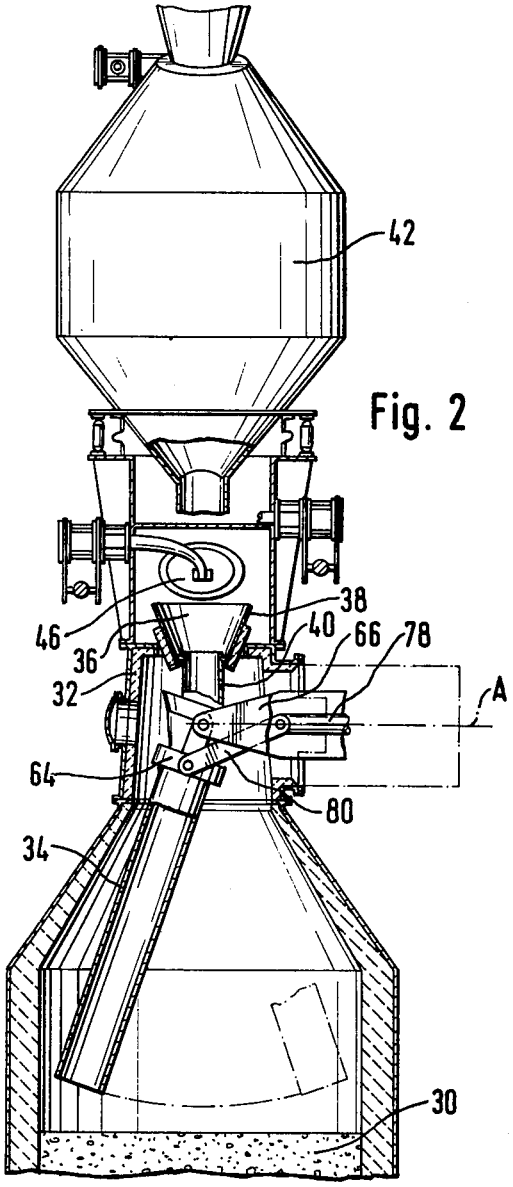
FIG. 2 is a schematic diagram in vertical section of the apparatus shown in FIG. 1 taken at a view perpendicular to the view in FIG. 1.
Figure 3:
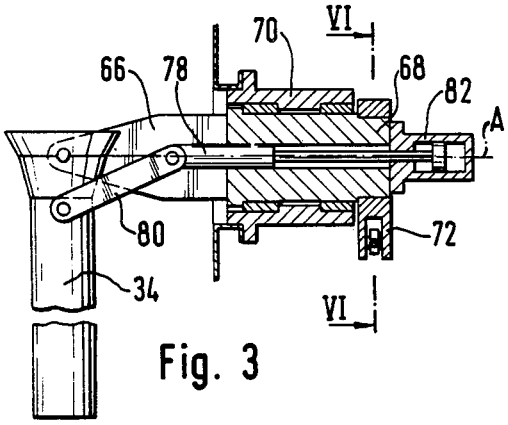
FIGS. 3, 4 and 5 are schematic diagrams of the chute in three different angular positions with the chute pivoting about a first axis.
Figure 6:
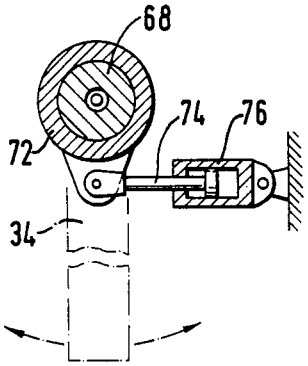
FIG. 6 is a schematic diagram of the mechanism for pivoting the chute about a second axis which is perpendicular to the first axis described in FIGS. 3, 4 and 5 and is a section view along the line VI—VI of FIG. 3.
Figure 4:
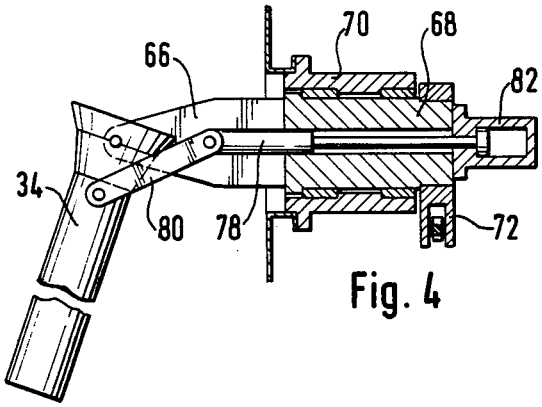
Figure 5:
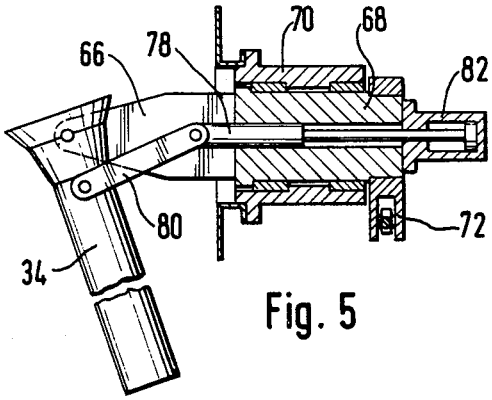

As shown in FIGS. 1 and 2, chute 34 is mounted to receive charge through channel 40 from chamber 42. Chute 34 comprises an elongated cylindrical tube having at one end thereof a divergent portion for receiving the charge. The other end of the chute 34 distributes the charge to areas of the burden within furnace 30. A particularly useful aspect of the present invention is that chute 34 is capable of being directed toward any point within the furnace 30. Direction of chute 34 is provided by the pivoting of chute 34 about two intersecting axes which are preferably perpendicular. As best shown in FIG. 2, chute 34 is pivotally suspended by a support fork 66 mounted laterally in the wall of furnace head 32. Fork support 66 is capable of being rotated about its longitudinal axis A to pivot chute 34 as shown by the dot and dash lines of FIG. 1. The mechanisms for pivoting chute 34 are shown in detail in FIGS. 3, 4, 5 and 6. As shown in FIGS. 3, 4 and 5, support fork 66 is integral with socket 68 to provide rotation of support fork 66 when socket 68 is rotated. Socket 68 is rotatably mounted in a conventional manner in housing 70 which can be hermetically sealed. Socket 68 at a position external to furnace 30 is integral with disc 72 which provides for rotation of socket 68 about is axis A. As best shown in FIG. 6 which is a sectional view along the lines VI—VI of FIG. 3, disc 72 is connected to rod 74 of hydraulic jack 76. However, it should be understood that any type of mechanism for rotating socket 68 may be used, such as, for example, an electrical motor. When jack 76 is actuated, disc 72, socket 68 and support fork 66 pivot about the common axis A to provide for pivoting of chute 34 in the direction of movement of rod 74 as shown by the arrows of FIG. 6. Thus, hydraulic jack 76 provides for pivoting of chute 34 about a first axis.

In order to provide for pivoting of the chute about a second axis, the following mechanism is provided. Socket 68 includes a cylindrical bore containing push rod 78 which is coaxial with socket 68 and which lies on axis A. Push rod 78 slides in an axial direction with respect to socket 68. In order to provide for the movement of push rod 78, push rod 78 is connected to a second hydraulic jack 82. However, it should be understood that hydraulic jack 82 can be replaced with any conventional means of moving the push rod 78 such as an electrical motor. A connecting rod 80 which is articulated at the end of push rod 78 extends to a position on chute 34 displaced a short distance from the connection of support fork 66 with chute 34. The movement of push rod 78 provides for pivoting of the chute 34 as shown in FIGS. 3, 4 and 5. The pivoting provided by push rod 78 is transverse to the pviotal movement provided by the hydrualic actuator 76. It should be understood that by controlling the hydraulic actuators 76 and 82, chute 34 may be directed toward any number of different areas within the furnace.

Figure 7:
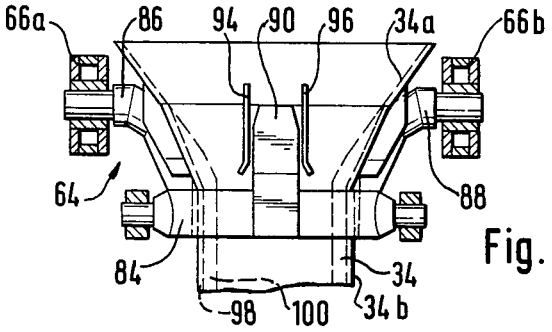
FIG. 7 is a front view of the suspension system for suspending the chute within a furnace.
Figure 8:
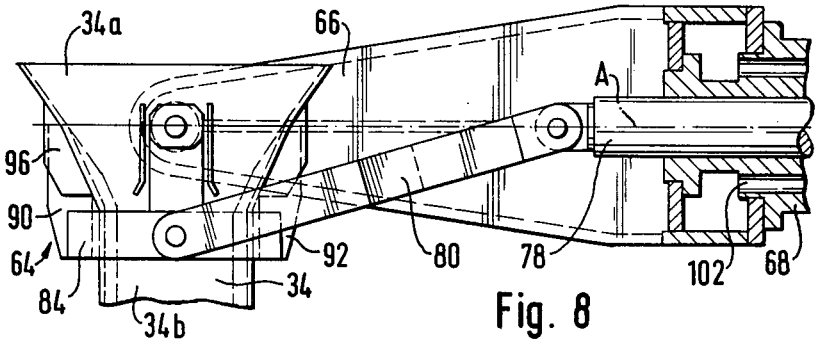
FIG. 8 is a side view of the apparatus shown in FIG. 7.
Figure 9:
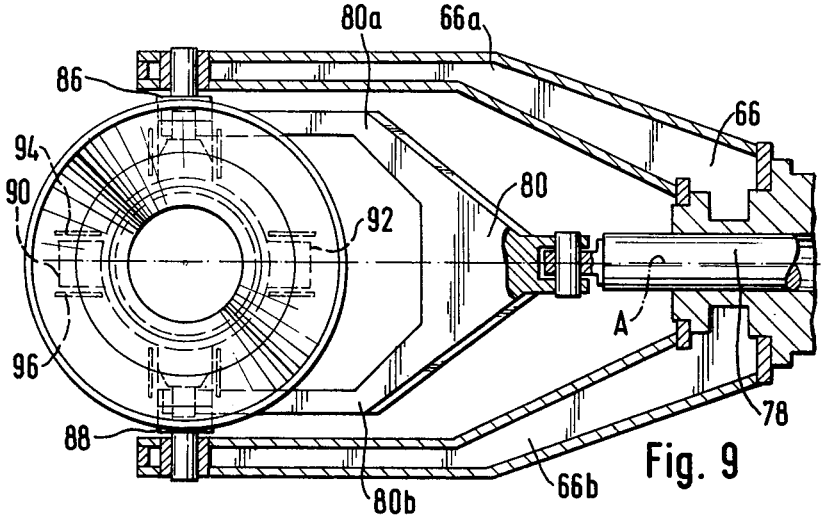
FIG. 9 is a top view of the apparatus shown in FIGS. 7 and 8.

FIGS. 7, 8 and 9 show in detail the advantageous suspension system for the chute 34. It should be understood that the principle advantages of this suspension system are that it allows for easy removal of chute 34, simple mechanical pivotal movement, and cooling of parts which would otherwise tend to wear appreciably during operation of the furnace. Saddle 64 has the general shape of a cone and is shaped to engage the divergent portion **34*a* of chute 34. Saddle 64 terminates in a ring 84, the internal diameter of ring 84 being slightly greater than the outer diameter of tubular portion 34*b* of chute 34 so as to securely engage chute 34. A series of brackets 86, 88, 90 and 92 are integral with ring 84 and extend axially and radially from this ring. The angle of inclination of brackets 86, 88, 90 and 92 with respect to the axis of ring 84 corresponds to the angle of divergence formed by the divergent portion 34*a* of chute 34. Thus, chute 34 is releasably supported by the combined action of brackets 86, 88, 90 and 92 and ring 84. Chute 34 preferably rests in saddle 64 and can be easily withdrawn by a lifting device to provide for extraction of chute 34. In order to insure that chute 34 will be firmly held in saddle 64 so as to prevent rotation about its longitudinal axis, the outer wall of the divergent part 34***a* of chute 34 is provided with four pairs of cheeks designed to engage brackets 86, 88, 90 and 92. In order to avoid excessive detail in the drawings, only cheeks 94 and 96 associated with bracket 90 are shown. In order to make it easier for chute 34 to be engaged within saddle 64, the lower part of each of the pairs of cheeks 94 and 96 is preferably made slightly divergent while the upper part of each of the brackets is slightly convergent as shown in FIG. 7.

The cylindrical wall of chute 34 is preferably provided with an external armoring 98 of refractory steel and is also provided with an internal lining 100 of material having a high resistance to wear. Although it is preferred that chute 34 have a cylindrical cross section, it should be understood that chutes having other cross sections may be used.

In order to provide for pivoting of chute 34 about the second axis, saddle 64 is provided with two brackets 86 and 88 disposed on opposite sides of chute 64. Brackets 86 and 88 are journaled in the ends of two branches 66*a* and 66*b* of fork support 66. In order to force pivoting around the second axis, connecting rod 80 at its end likewise takes the form of a fork in which two branches 80*a* and 80*b* engage ring 84 so as to provide movement of chute 34. The extremities of the two branches 80*a* and 80*b* of connecting rod 80 are journaled onto ring 84, while the opposite end of connecting rod 80 is articulated to push rod 78. The pivoting movement of fork 66 about axis A and the sliding movement of push rod 78 cause the saddle 64 to pivot about two perpendicular axes, and the combined effects of these pivotal movements enables the lower end of chute 34 to be displaced over a predetermined curve.

In order to reduce wear on friction bearing surfaces, support fork 66 is provided with hollow passageways to allow for continual circulation of cooling fluid supplied through conduit 102 provided in socket 68. The continuous circulation of cooling fluid to the ends of support fork 68 enables the journals to be cooled to insure satisfactory operation of this system and to reduce wear on the parts. It is possible, although not shown in the drawing, to provide a similar cooling system via push rod 78 and connecting rod 80 to the ends of the branches of fork 80*a* and 80*b*. In the embodiment illustrated in FIGS. 7, 8 and 9, however, a hermetic communication for the cooling system would have to be provided through the articulation joint between connecting rod 80 and push rod 78. In the embodiment shown in FIGS. 10, 11 and 12, this hermetic sealing at the juncture is avoided.

Referring to FIGS. 10, 11 and 12, a portion of the elements in these FIGURES have already been described with respect to previous drawings, such as chute 34, fork 66 and socket 68. The pivoting movement of chute 34 about the second axis is provided by a push rod 104 which, in the embodiments shown in FIGS. 10, 11 and 12, is no longer coaxial with respect to socket 68. The sliding movement of push rod 104 is produced by hydraulic jack 106 or other mechanical means as may be desired. The inclined position of push rod 104 in socket 68 enables the connecting rod to be dispensed with and the push rod 102 to act directly on chute 34, or, where applicable, on its saddle, which is not shown in the present drawings.

Piston of push rod 104 is fork shaped with two branches 104*a* and 104*b*, the view of branch 104*b* being obstructed in the drawings. The interaction between chute 34 and branches 104*a* and 104*b* of push rod 104 is brought about by the means of a pair of cam suraces 108 and 110 which are operated by a cam shaped finger 112 which extends inwardly from fork 104*a*. During sliding movement of push rod 104, finger 112 pivots chute 34 as shown in the different angular positions in FIGS. 10, 11 and 12. In order to reduce the shearing forces between finger 112 and cams 108 and 110, the surfaces of finger 112 and cams 108 and 110 are cambered as shown in the drawings. It should be understood that if a saddle is provided, cams 108 and 110 will be positioned on the ring of this saddle.

Because push rod 104 is no longer jointed, a fluid circulation passage may be constructed within push rod 104 to allow cooling of the finger 112 in order to cool the friction surfaces and reduce wear thereon.

The process of charging the furnace by the charging apparatus shown in the preceding FIGURES will be described with respect to FIGS. 13 through 18. If it is desired for the end of the chute 34 to move in a rectangular pattern, the two hydraulic actuators are operated in sequence and at constant amplitude. In this case, movement of chute 34 defines a four-sided pyramidal surface which will be square if the pivoting angles generated by support fork 66 and the push rod, 68 or 104, are equal; rectangular if these angles are unequal. FIG. 15 shows the type of movement through a furnace having rectangular walls 114. FIGS. 13, 14, 15 and 16 show the different positions of chute 34 as marked with reference characters C, D, E and F. The projection plan has been divided into an abscissa X and ordinate Y which intersect at point O.

As shown by the lines 118 in FIG. 15, the horizontal projection of the movement of the lower end of chute 34 is not rectangular, but rather, slightly curved so that the lower end of chute 34 moves away from walls 114 when chute 34 approaches the four corners. For example, the lower end of chute 34 is closer to the wall at position E than it is at positions D or F.

Figure 17:
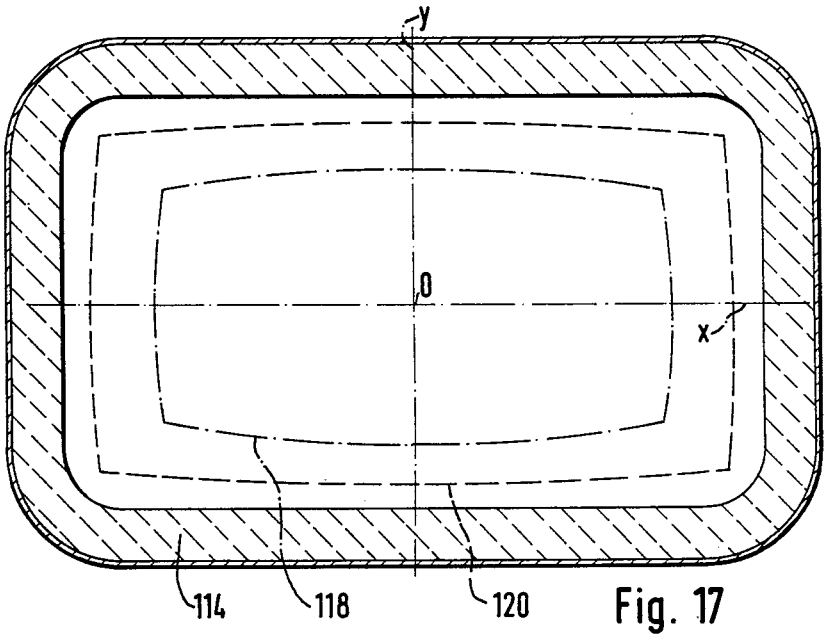
FIG. 17 is a schematic top view of a furnace.

As the charge falls through chute 34 it follows a nearly perfectly linear trajectory along the axis of chute 34. However, when the charge exits from chute 34, the charge free-falls in a parabolic pattern as shown best in FIGS. 13 and 16. As the end of chute 34 moves further away from the vertical position, the distance between the end of chute 34 and the burden 116 increases. This increasing distance is best shown in FIG. 14. Thus, as the chute 34 approaches the corners of the furnace, the charge must fall at through a relatively large distance. Thus, as the chute 34 approaches the corners, the control of the direction of the charge becomes less accurate. FIG. 17 demonstrates the problem encountered as chute 34 is moved toward the corners of the furnace. The horizontal projection of the course of chute 34 is represented by reference character 118. During the course of the charging operation, the charge is deposited in accordance with trajectory 120 when the lower end of chute 34 follows trajectory 118. Owing to the parabolic fall from the end of chute 34, the charge is positioned slightly away from wall 114 when the chute 34 approaches the corners. This is due to the fact that line 118 only represents a projection of the traveling of the lower end of chute 34 but does not represent the height movement of the end of chute 34. In this manner, almost the entire surface of the burden may be swept by the chute 34 when it is moved in concentric rectangular trajectories. A generally uniform layer can be deposited, but, the layer will nevertheless slightly subside in the region of the four corners.

Figure 18:
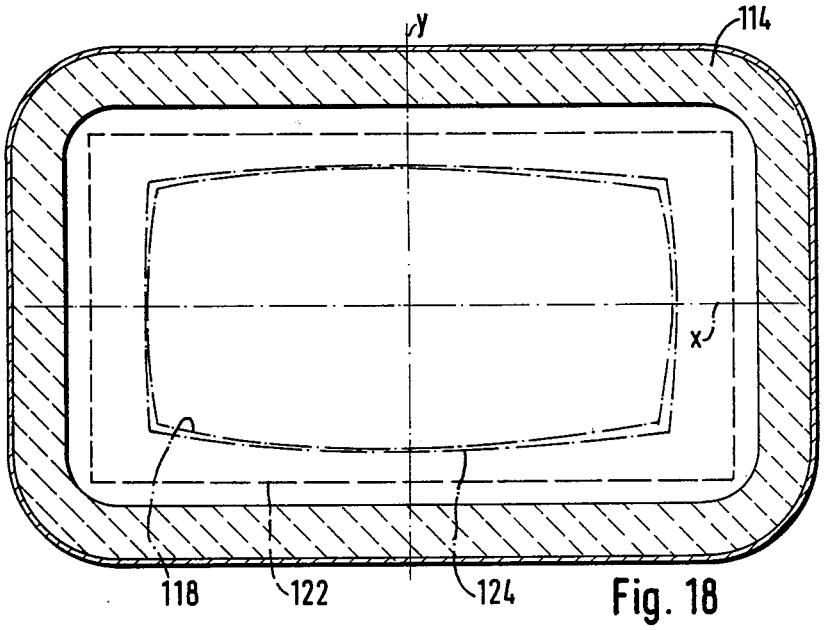
FIG. 18 shows a schematic view of the furnace shown in FIG. 17 and illustrates the corrections in the chute angle required to deposit the charge in a rectangular pattern.

Although the above-described charging process enables the charging material to be distributed in an acceptable manner, the above-described charging apparatus can be modified in such a way to allow for a uniform distribution of charge material over the entire cross section of the furnace. FIG. 18 shows a horizontal schematic view of the furnace with rectangular walls 114. Lines 122 illustrates a completely rectangular deposition of the charge along the four sides of the furnace. To obtain such a deposit, chute 34 must be moved along the trajectory shown by line 124 instead of trajectory 118. In other words, the chute 34 must be raised when it approaches the corners of the furnace in order for the charge to fall in a rectangular pattern.

FIG. 19 shows an alternative embodiment of the charging apparatus which allows for deposition of charge in a rectangular pattern on the burden. FIG. 19*a* shows a view similar to that view shown in FIG. 3. A mechanical correction device is associated with the displacement mechanism for chute 34. Mechanical correction device 126 comprises a pair of rollers 128*a* and 128*b* affixed to rod 130 which is integral with the piston of jack 82. A pair of cams 132 and 134 are mounted on both sides of rollers 128*a* and 128*b* by means of slide bars 136 and 138 which are in turn rigidly connected to the wall of the furnace. Cams 132 and 134 include a hollow portion to allow passage of rod 130 therethrough. Preferably, cams 132 and 134 are identical to allow for interchangability of the cams. The surfaces of cams 132 and 134 which are adjacent rollers 128*a* and 128*b* have a raised part and a recess on their circumference. This contour is shown in FIG. 19*b* where cam 132 is shown. FIG. 19*b* also shows one of the two rollers 128 moving over the surface of cam 132.

When a rectangular surface is being swept by chute 34 as shown in FIGS. 17 and 18, chute 34 is preferably positioned in such a way that movement of the push rod 78 and connecting rod 80 will displace the end of the chute in the direction of the minor dimension of the furnace. Pivoting movement of support fork 66 will preferably displace the lower end of the chute 34 is accordance with the major dimension of the furnace. Thus, the support fork 66 will pivot the chute in accordance with coordinate x and the push rod will pivot the chute in accordance with coordinate y. In the process of placing a charge along the longer side wall of the furnace, the push rod 78 is in a position between cams 132 and 134 and fork support 66 is pivoted by means of its jack which is not shown in FIG. 19*a*. The cams 132 and 134 are affixed to slide bars 136 and 138 so that in the extreme position of jack 82 and push rod 78, the rollers 128*a* and 128*b* will be in contact with either cam 132 or cam 134, and thus, the chute 34 will be pushed upwardly so as to distribute the charge into the corner of the furnace. The axial position of rollers 128*a* and 128*b* would be kept constant if the cams were not present, while the angular position of the rollers would change with the pivoting movement of support fork 66. The rollers 128*a* and 128*b* move over the axial surface, for example, of cam 132 because of the profile of the surface as shown in FIG. 19*b*. Rollers 128*a* and 128*b* are displaced axially in accordance with the contours of cam 132. Cam 132 will be arranged in a manner so as to allow for correction of the angle of chute 34 as shown in FIG. 18. The system functions similarly when rollers 128*a* and 128*b* interact with cam 134. The mechanical correction device shown in FIG. 19 thus provides a means of adjusting the trajectory of the chute 34 to provide for placement of the charge along the entire rectangular periphery of the burden.

However, the device described in the above paragraph only enables correction to be made for two parallel sides of the furnace. In most cases, this mechanical means of correction is sufficient since on the smaller sides of the furnace there is not that much angular adjustment necessary so that correction can be dispensed with. Where it is desired to provide a device which will correct the trajectory of the chute 34 along all four sides of a rectangular furnace, the apparatus shown in FIGS. 20, 21 and 22 is provided thus allowing the charge to be deposited accurately in accordance with predetermined theoretical curves. FIG. 20 shows another embodiment of the invention in a view corresponding to FIG. 3. The correction device shown in FIG. 20 is an electromechanical correction device. For this purpose rod 140 is integral with the piston of the jack and is thusly displaced at the same time as the push rod. The end of rod 140 slides inside the core of an induction coil 142 which constantly generates a signal which is a function of the position of plunger 140 and therefore of the angular position of the chute in a plane perpendicular to the x axis. These signals are transmitted to a data processing device. As the angular positions of the chute 34 are calculated theoretically be means of computer, the data processing device compares the actual signal with the signal stored in the program. When a comparison between the actual value and the program value of angular deviation is zero, the jack is automatically blocked in its position while socket 68 is allowed to continue to rotate. FIGS. 21 and 22 show jack 76 which actuates support fork 66 and an electromechanical device similar to that described by reference to FIG. 20. An induction coil 146 continuously emits signals corresponding to the position of the piston of the jack 76 and to the angular position of the chute 34. The signals induced in coil 146 are likewise compared to the signals stored in the program in the data processing device and the action of jack 76 is automatically stopped when its position corresponds to the desired position represented in the program. It is possible to establish a program for sweeping the burden in the furnace so as to provide a sweeping pattern of any desired type. Thus, it is possible to compensate for irregularities caused by the free-fall trajectory of the material between the lower end of chute 34 and the surface of the burden.

Figure 23:
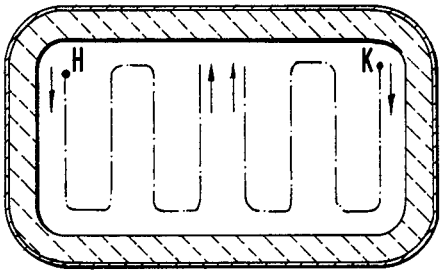
FIGS. 23, 24, 25 and 26 are schematic top views of a furnace and show various charging patterns for depositing a uniform sheet of charge.
Figure 24:
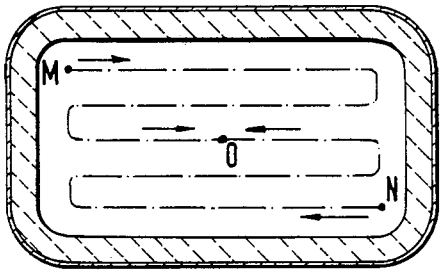

FIGS. 23, 24, 25 and 26 show schematic diagrams of various possible charging methods. FIG. 23 shows a process for depositing a uniform layer in a zig-zag transversal. The chute is moved into the angular position according to one of the four corners, for example, point H. The two jacks driving the chute are actuated successively and alternatively in such a manner so as to cause the chute to follow the trajectory indicated by the arrows. However, it is already well known in the art that it is preferable to charge the furnace in a pattern that moves inwardly from the walls of the furnace toward the center of the furnace. The chute is directed to point K on the burden and is moved inwardly toward the center of the furnace where the proportioning valve is closed. Chute 34 is then directed to point K and the proportioning valve is opened and the chute moves inwardly toward the center of the furnace. FIG. 24 shows a method similar to that shown in FIG. 23, except that the charge is deposited in the longitudinal direction from point M to O and then from point N to O.

Figure 25:
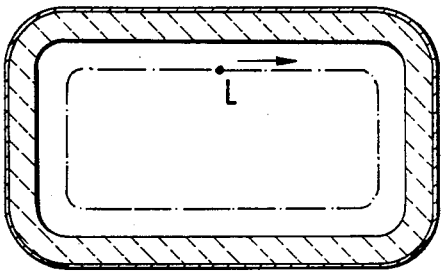

FIG. 25 shows another method of depositing charge into the furnace. In FIG. 25, a peripheral layer is deposited on the surface of the burden and the lower end of the chute moves in generally a rectangular loop starting at point L. When the chute 34 is returned to a point L, the chute may proceed according to a program by various routes of depositing the material inside the peripheral strip. For example, the lower end of the chute may be moved a certain distance toward the center of the furnace and a new rectangular strip deposited inside the proceeding one. This process may be continued until the entire burden has been covered with charge. It is also possible to deposit the charge inside the rectangular strip by adopting one of the methods shown in FIGS. 23 or 24.

Figure 26:
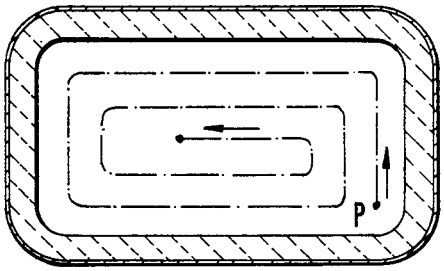

FIG. 26 shows a charging method wherein the charge is delivered at point P. The chute can be continuously displaced in the direction shown in the arrows until the center is reached. This method can be regarded as moving the chute in a rectangular spiral.

FIGS. 23, 24, 25 and 26 are merely exemplary of the infinite number of charging methods possible with the apparatus of the present invention. A person qualified in charging a furnace can decide upon the configuration that will insure optimum operation of the furnace in which the charging apparatus is installed. Also, the above-described figures show the ease by which the apparatus of the present invention can be used in furnaces having an irregular cross section, whether polygonal or arcuate. For each of the charging methods illustrated in FIGS. 23–26, or, for other charging methods, the commencement and termination of movement of charge through valve 52 is programmed to take into account the flowing time of the material between valve 52 and the surface of the burden. Movement of the chute is delayed a certain time after the opening of the valve 52 and valve 52 will be closed a certain time before the chute comes to a final or intermediate stop in order to avoid any interruptions in depositing the layer or duplicating the layer.

Although the charging apparatus shown in the previously discussed FIGURES has a single chamber 42 for providing the charge, it should be understood that a furnace of the type having more than one chamber may be used. For example, when two chambers are used they can be located side by side and designed to operate alternatively. Also, in the operation of blast furnaces, since extremely explosive gases involved, safety measures or regulations require that a buffer medium be situated between the atmosphere and the interior of the furnace. Generally, buffer medium is provided for by an inert gas. In the installation shown in FIG. 1, these requirements can be satisfied by the provision of a double chamber system, that is, a second chamber likewise equipped with an upper and lower sealing valves being mounted above chamber 42. In this case, the buffer medium will comprise either the lower chamber or the upper chamber according to whether the upper chamber is opened or closed. With the two superimposed chambers, the charging process can operate with greater flexibility since the upper chamber provides an intermediate storage chamber for charging material. The lower chamber can be evacuated more rapidly thus enabling the charging process to be speeded up. Furthermore, the upper chamber can be charged while the lower chamber is being evacuated so that the means of transport conveying the charge material to the top of the furnace can be operated for longer periods of time and at a greater frequency thus enabling the transport equipment to be built of a relatively small size and capacity. If desired, a buffer chamber can be provided that is similar to that disclosed in U.S. Pat. No. 3,955,693.

By way of conclusion, the present charging apparatus and method of charging enables the placement of charge within the burden in the desired manner. The apparatus can be dismantled as a complete unit and this simplicity allows for the down time of the furnace to be reduced. The pivoting of the chute about two perpendicular intersecting axes enables the chute to perform simple and accurate movements. The fact that there is a point on the chute which is always fixed in space, a point about which the chute pivots, is an important characteristic of the furnace charging apparatus. It should be understood that this characteristic is lacking in German Pat. No. 2,104,116 in which the two pivoting axes do not intersect so that the chute has to perform an extremely complicated movement in view of the fact that there is no fixed pivoting point. The different automatic control devices shown in FIGS. 19, 20, 21 and 22 and also the different charging methods, some of which are illustrated in FIGS. 23, 24, 25 and 26, enable the furnace charging apparatus to be designed in accordance with existing furnaces. Moreover, the present invention allows for the frictional areas near the chute to be cooled with cooling fluid which is circulated through the fork support. This renders the process extremely reliable and allows for reduced wear on the apparatus.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In a shaft furnace, improved charge distribution apparatus comprising:

elongated distribution chute means;

support means for said chute means, said support means extending through the furnace wall at a single location and being rotatable about a first axis, said support means including a base portion and a pair of arms extending therefrom;

means pivotally coupling said chute means to said support means arms adjacent a first end of said chute means, said coupling means defining a second axis transverse to said first axis, said first and second axes intersecting at a point;

means for rotating said support means to pivot said chute means about said first axis; and drive means connected to said chute means for imparting motion to said chute means to cause said chute means to pivot about said coupling means defined second axis, said motion imparting means in part extending through the furnace wall at said single location.

2. The apparatus of claim 1 wherein said chute means comprises:

a tubular member, said tubular member having a frustoconical charge receiving portion at the said first end thereof.

3. The apparatus of claim 2 wherein said tubular member has an external wall of refractory steel and an internal lining of wear resistant material.

4. The apparatus of claim 1 wherein the furnace includes a frustoconical feed spout for delivering charge material from a storage hopper to the charge distribution apparatus and wherein said distribution apparatus further comprises:

fixed position tubular channel defining means for establishing communication between the feed spout and said chute means, said channel defining means extending into the first end of said chute means.

5. The apparatus of claim 4 wherein said channel defining means includes a peripheral shoulder which engages a flange on the inner wall of the feed spout, said channel defining means being releasably supported from the feed spout by cooperation between said shoulder and flange.

6. The apparatus of claim 1 wherein the means for rotating said support means and the means for causing such chute means to pivot about the axis each comprise hydraulic actuators having a piston integral with a sliding plunger, said actuators being associated with an electromechanical device comprising an induction coil in which the sliding plunger is positioned to provide an output signal proportional to the position of the plunger within the induction coil, and means comparing the output signal with a control signal to stop the hydraulic actuators when the difference between the output signal and the control signal is equal to zero.

7. The apparatus of claim 6 further including a proportioning valve which serves to regulate flow of charge material into said chute means.

8. In a shaft furnace, improved charge distribution apparatus comprising:

elongated distribution chute means;

support means for said chute means, said support means being rotatable about a first axis and including a base portion and a pair of arms extending therefrom into the furnace;

means pivotally coupling said chute means to said support means arms adjacent a first end of said chute means, said coupling means defining a second axis transverse to said first axis, said first and second axes intersecting at a point;

means for rotating said support means to pivot said chute means about said first axis;

a reciprocal rod, said rod extending through said support means base portion;

means connecting a first end of said rod to said chute means; and means for imparting motion to said rod at the second end thereof whereby said chute means will pivot about said second axis on said coupling means.

9. The apparatus of claim 8 wherein said means for rotating said support means comprises:

a first hydraulic jack; and wherein said means for imparting motion to said rod comprises:

a second hydraulic jack.

10. The apparatus of claim 9 wherein said rod is coaxial with said support means base portion and wherein said means for connecting the first end of said rod to said chute means comprises a linkage having a pair of parallel arms, said parallel arms having axes which define a plane which is inclined with respect to the axis of said rod.

11. The apparatus of claim 8 wherein said reciprocal rod is inclined in relation to said first axis and its inner end is constructed in the form of a fork having two branches which are rotatably connected to said chute means.

12. The apparatus of claim 11 wherein the rotatable connection between the two branches of the rod and the chute means is provided by two pairs of cams oppositely disposed with respect to the chute means and fingers extending from each branch and positioned between each pair of cams.

13. The apparatus of claim 12 wherein the surfaces of the cams and fingers are cambered.

14. The apparatus of claim 8 further including a pair of rollers mounted on an extension of said reciprocal rod, said rod extension being capable of linear movement between one extreme position and another extreme position, said apparatus further comprising cam means mounted on either side of the rollers of said pair, said cam means engaging said rollers at the said extreme positions to pivot said chute means.

15. The apparatus of claim 14 wherein said cam means are mounted on stationary rails, said cam means being adjustable with respect to the said rails.

16. In a shaft furnace, improved charge distribution apparatus comprising:

elongated distribution chute means, said chute means including a tubular member having a frustoconical charge receiving portion at the first end thereof;

support means for said chute means, said support means being rotatable about a first axis and including a base portion and a pair of arms extending therefrom into the furnace, said support means further comprising a saddle pivotally connected to said arms and having a generally conical shape terminating in a ring, the ring having an internal diameter less than the maximum diameter of the frustoconical chute means portion, said saddle engaging the exterior of said chute means frustoconical portion;

means for rotating said support means to pivot said chute means about said first axis; and means for imparting motion to said chute means to cause said chute means to pivot about a second axis defined by the pivot connection between said support means arms and saddle, said second axis being transverse to said first axis and intersecting said first axis at a point.

17. The apparatus of claim 16 wherein said support means ring includes a series of brackets extending axially and radially from the ring and wherein the frustoconical portion of said chute means includes external cheeks which engage said brackets to prevent rotation of said chute means with respect to said support means saddle.

18. The apparatus of claim 16 wherein said support means saddle includes a pair of brackets positioned at opposite sides of said chute means, said brackets being pivotally connected to said support means arms, and wherein said means for causing said chute means to pivot about the second axis comprises:

a reciprocal rod, said rod extending through said support means base portion:

means connecting a first end of said rod to said chute means; and means for imparting motion to said rod at the second end thereof.

19. The apparatus of claim 18 wherein said reciprocal rod is coaxial with said support means base portion and wherein said means for connecting the first end of said rod to said chute means comprises a linkage having a pair of parallel arms, said parallel arms having axes which define a plane inclined with respect to the axis of said reciprocal rod.

* * * * *